United States Patent [19]

Winyard

[11] Patent Number: 4,655,698

[45] Date of Patent: Apr. 7, 1987

[54] COMPRESSOR-SCAVENGING EDUCTOR SYSTEM

[75] Inventor: David C. Winyard, Glen Burnie, Md.

[73] Assignee: The United States of America as represented by the Secretary of the Navy, Bethesda, Md.

[21] Appl. No.: 759,567

[22] Filed: Jul. 26, 1985

[51] Int. Cl.[4] ..... F04C 29/02; F04C 29/04

[52] U.S. Cl. ..... 418/85; 418/88; 418/97; 418/100; 418/DIG. 1; 184/6.16

[58] Field of Search ..... 418/97, 85, 88, 195, 418/100, DIG. 1; 184/6.16; 417/902

[56] References Cited

U.S. PATENT DOCUMENTS

| | | | |
|---|---|---|---|
| 1,953,253 | 4/1984 | Ogilvie | 418/97 |
| 2,701,684 | 2/1955 | Hirsch | 184/6.16 |
| 3,168,236 | 2/1965 | Lamberton | 417/295 |
| 3,265,295 | 8/1966 | Cyr | 418/9 |
| 3,759,348 | 9/1973 | Kasahara | 418/DIG. 1 |
| 3,797,972 | 3/1974 | Nakayama | 418/100 |
| 4,025,244 | 5/1977 | Sato | 418/97 |
| 4,035,114 | 7/1977 | Sato | 418/84 |
| 4,070,166 | 1/1978 | Emanuelsson | 418/DIG. 1 |
| 4,209,287 | 6/1980 | Takada | 418/93 |
| 4,477,233 | 10/1984 | Schaefer | 417/902 |

OTHER PUBLICATIONS

Webster's New International Dictionary of the English Language, 2nd Edition, 5/1952, p. 1342, definition of "journal".

*Primary Examiner*—Carlton R. Croyle
*Assistant Examiner*—Jane E. Obee
*Attorney, Agent, or Firm*—Luther A. Marsh

[57] ABSTRACT

The present invention overcomes performance losses of positive displacement compressors due to internal liquid recirculation. This is achieved by removing or scavenging liquid that leaks out of the compression pocket before it is captured by another lower-pressure compression pocket of the compressor. The scavenged liquid is collected in the bottom of the compressor pressure vessel and cooled before it is reinjected into the compressor to complete the cycle.

27 Claims, 8 Drawing Figures

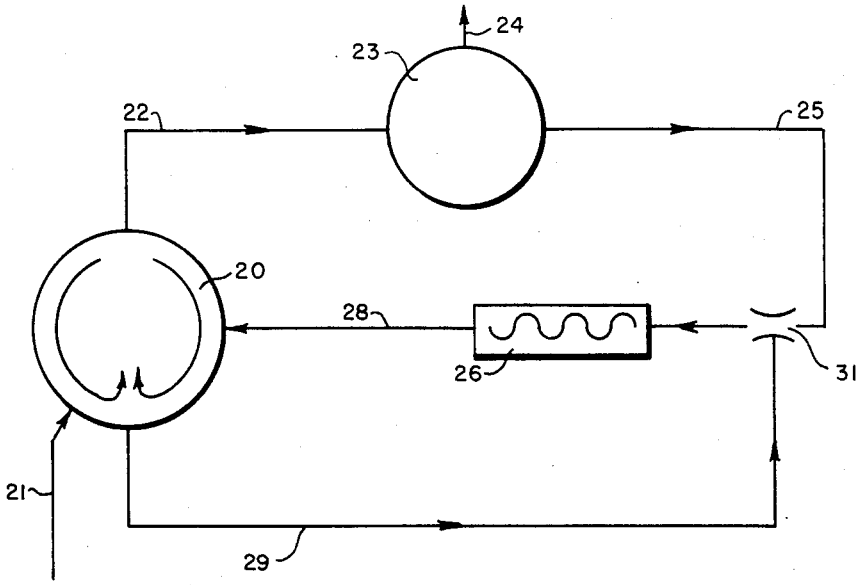
FIG. 4
FIG. 4a
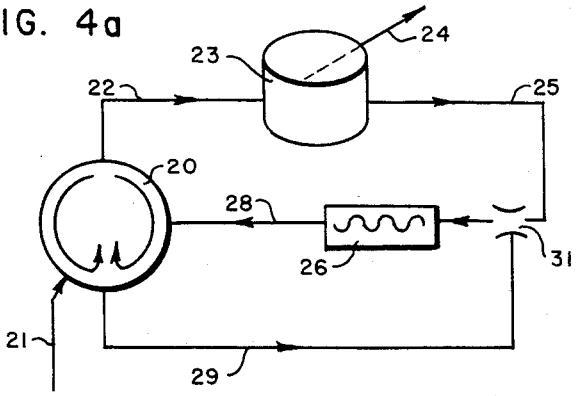

COMPRESSOR-SCAVENGING EDUCTOR SYSTEM

BACKGROUND OF THE INVENTION

Positive-displacement compressors are commonly used in gas and refrigeration service, liquid, such as oil or water, is often injected into these compressors in order to lubricate the mechanism. The liquid injection also serves to seal machine clearances to prevent leakage of the compressed fluid and further serves to absorb the heat of the compression cycle itself.

The injected liquid is separated from the compressed fluid in a discharge receiver resulting in compressed fluid which is free of injected liquid and separated liquid. The separated liquid is cooled and reinjected into the compressor to complete the cycle. Flow of the rejected liquid back into the compressor is maintained by the compressor differential pressure and is controlled by an orifice or other pressure reducing device.

Some of the injected liquid will leak from the compression pockets of the compressor through the mechanism clearances towards the compressor inlet where it is drawn back into the compressor in an uncontrolled manner with the inlet gas or vapor. Liquid that is recirculated with the compressor in this way may be several times the amount of liquid injected into the compressor.

SUMMARY OF THE INVENTION

The present invention overcomes the undercontrolled liquid injection systems above by the application of a scavenged liquid-injected compressor. In the scavenged liquid-injection system, liquid that leaks out of the compression pockets is collected in the bottom of the compressor casing. The collected liquid is cooled and then reintroduced into the compressor through the liquid injection system in a controlled volumetric manner.

BRIEF DESCRIPTION OF THE DRAWINGS

A more complete appreciation of the invention and many of the attendant features thereof will be readily appreciated as the same becomes better understood by reference to the following detailed description when considered in connection with the accompanying drawings wherein:

FIG. 4 is a schematic of a positive-displacement unit utilizing the scavenged liquid-injection means showing an eductor type scavenging circuit.

FIG. 4*a* is a perspective view of FIG. 4.

DESCRIPTION OF THE PREFERRED EMBODIMENT

Figure 1:
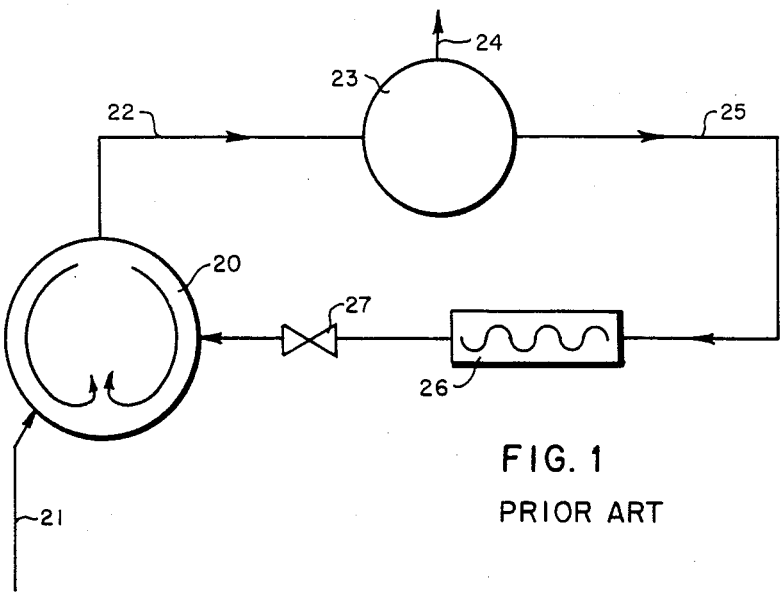
FIG. 1 PRIOR ART
FIG. 1 is a schematic of a positive-displacement unit not using the scavenged liquid-injection apparatus.

Referring now to the drawings wherein like reference characters designate identical or corresponding parts throughout the several views.

The uncontrolled internal recirculation of liquid adversely affects compressor performance in several ways. First, this phenomena has the tendency of reducing compressor capacity by taking up space in the compression pocket. Secondly, because the uncontrolled recirculated liquid is not cooled before it is reinjected back into the compressor the uncontrolled recirculated liquid has a lowered density thereby lowering compressor volumetric efficiency. Furthermore, this phenomena increases the likelihood of damage to the compressor by overpressurizing an overinjected compression pocket. Also the uncontrolled recirculated liquid may be unstable, causing widely varying liquid content from one compression pocket to the next.

The inventor has found that performance losses due to the uncontrolled internal liquid recirculation may be avoided by removing or scavenging liquid that leaks out of the compression pocket before it is captured by another lower-pressure compression pocket.

Figure 2:
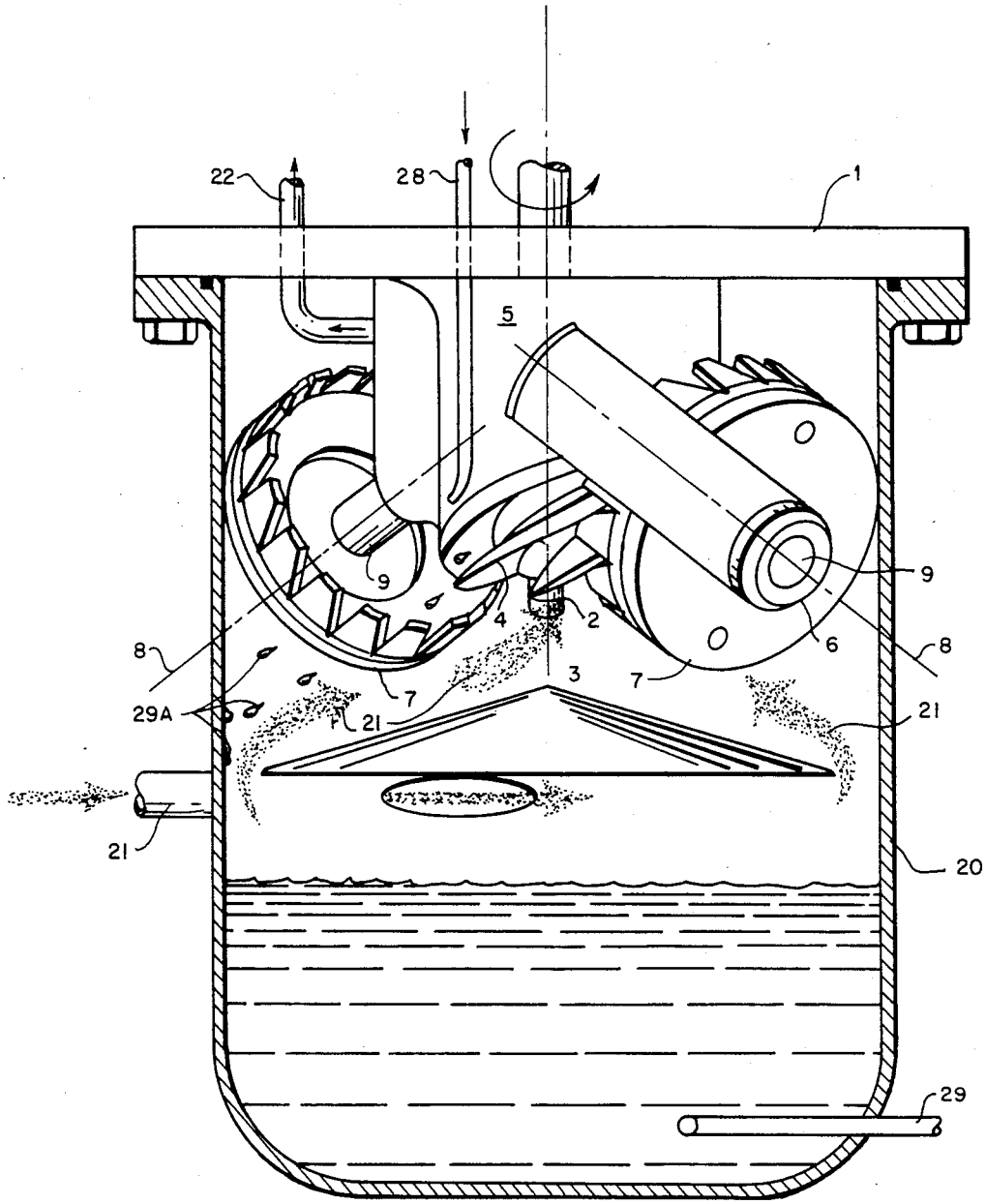
FIG. 2 is a side cut-away view of a positive-displacement unit utilizing the scavenged liquid-injection means.

Generally, illustrated in FIG. 2 is a single-screw compressor using this scavenging process. Liquid 29A that leaks out of the compression pockets is flung out of the rotor threads by centrifugal force. The scavenged liquid is collected in the bottom of the compressor vessel, not numbered.

Scavenged liquid collected by this means must be cooled and reinjected into the compressor to complete the liquid injection cycle. This results in the fact gas or vapor 21 entering the compressor is not preheated or displaced by uncontrolled recirculating liquid.

In particular, the compressor comprises a support structure 1, a mainrotor 2 with a rotational axis 3 and a journalling means, not numbered but generally coaxial with rotational axis 3. The compressor further comprises a toroidal surface that is provided with a plurality of projecting threads 4 having crests.

A casing means 5, attached to the support structure 1, has a plurality of journalling means, 6 and not numbered but generally coaxial with 3, to journal the mainrotor 2. Journalling means 6 of course is to journal the gaterotors 7.

The casing means 5 also has a gas discharge through pipe means 22 the gas discharge is compressed and contains liquid, which is liquid injected through pipe means 28, which is separated from the compressed gas in discharge receiver 23 resulting in compressed fluid channeled through pipe means 24 and separated liquid channeled through pipe means 25. The casing means 5 further has a liquid injection through pipe means 28 and has symmetry of revolution with respect to the mainrotor rotational axis 3.

The gaterotors 7 have a rotational axis 8 and a journalling means 9. The pressure vessel is provided with a gas inlet means 21. The pressure vessel is attached to the support structure 1 and encases the mainrotor 2, gaterotors 7 and casing means 5.

When the compressor is in operation the mainrotor projecting thread crests 4 are adapted to operatively cooperate with the casing 5 and mesh with the teeth of said gaterotors 7. This operation varies the pressure of the inlet gas 21 with respect to the pressure of the discharge gas in pipe means 22.

The casing journalling means for the rotors is operatively connected to the mainrotor and gaterotors journalling means.

The liquid injection through pipe means 28 is operatively connected to the gas discharge in pipe means 22 through a separator circuit means 22–28. The liquid injection into the compressor through pipe means 28, among other things, serves to lubricate the cooperating rotors 2 and 7.

The liquid injected through pipe means 28 is collected in the pressure vessel of the compressor and recycled, through a scavenged liquid circuit means 29 and 30 where it is reinjected in a controlled fashion back into the compressor through pipe means 28.

FIGS. 3–6 show a compressor with a separator circuit means and with the introduction of the inventor's scavenged circuit means. As noted above the fluid flows first through the separator circuit and then through the scavenging circuit.

Figure 3:
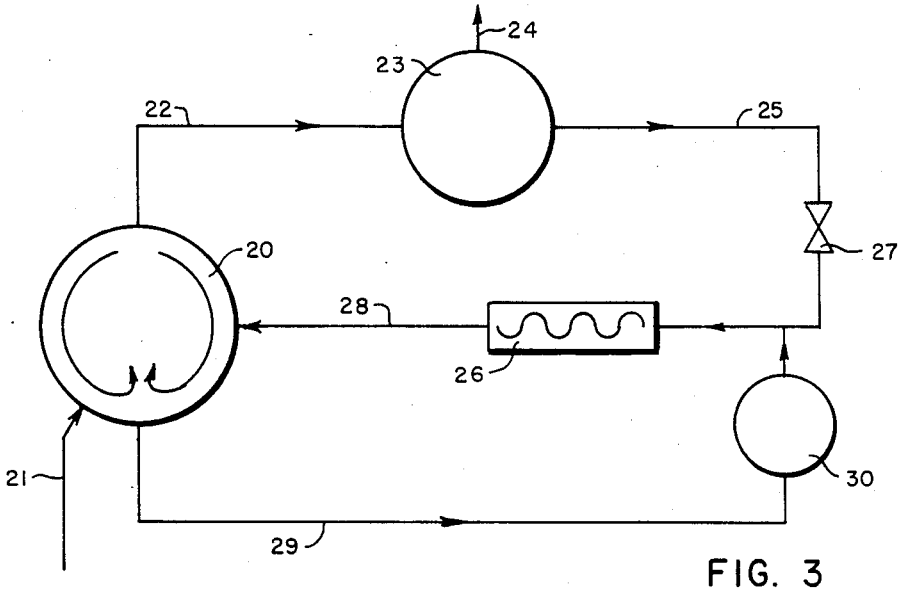
FIG. 3 is a schematic of a positive-displacement unit utilizing the scavenged liquid-injection means showing a pump type scavenging circuit.
Figure 3A:
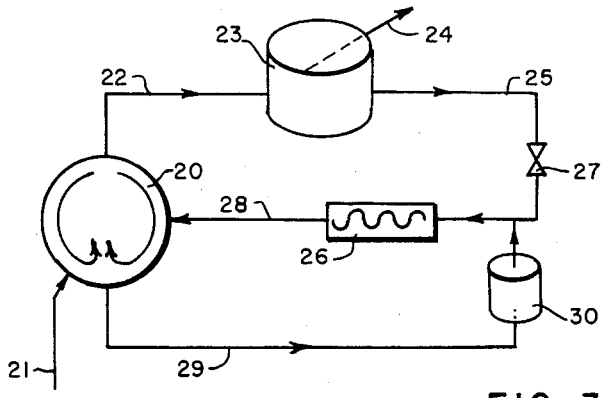
FIG. 3*a* is a perspective view of FIG. 3.

FIG. 3 and 3*a* use a pump means 30 in the scavenged circuit means for introducing the scavenged liquid back into the separator circuit means and ultimately into the injector means 28.

Figure 5:
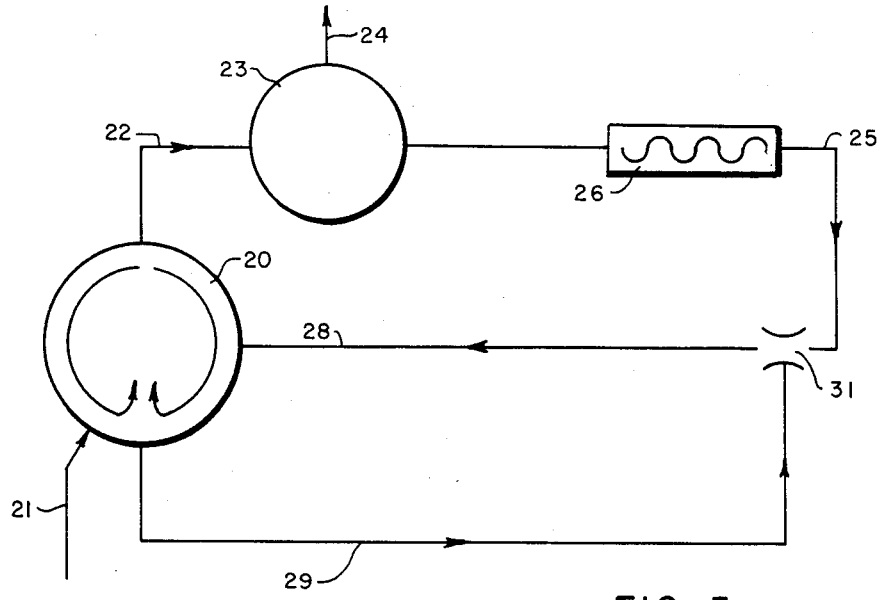
FIG. 5 is a schematic of a positive-displacement unit utilizing the scavenged liquid-injection means showing another eductor type scavenging circuit embodiment.
Figure 6:
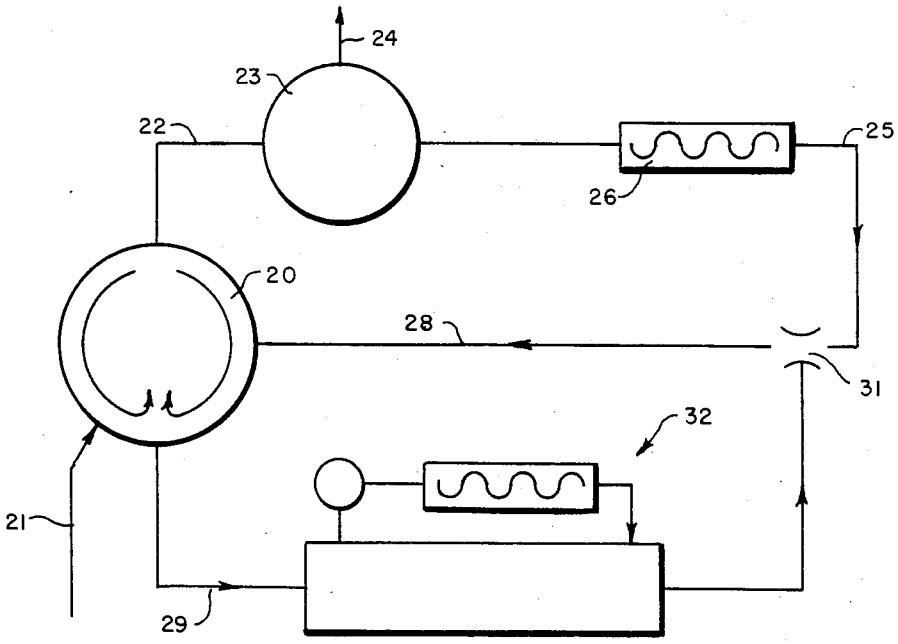
FIG. 6 is a schematic of a positive-displacement unit utilizing the scavenged liquid-injection means showing still another eductor type scavenging circuit embodiment.

FIGS. 4–6 use an eductor means 31 in the scavenged circuit means 29 and 31 for introducing the scavenged liquid back into the separator circuit means and ultimately into the injector pipe means 28.

Because the scavenged liquid circuit of FIGS. 3 and 3*a* utilize a pump means 30, the compressors are limited by several factors. First, this system includes a mechanical invention. increase system power input and complexity. Second, control of the injection system over the range of compressor operation would be complicated and difficult to design. Finally, compensation for machine wear and increased injection liquid loss is likewise problematic.

The eductor scavenged liquid circuits means 29 and 31 of FIGS. 4–6 eliminate the problems encountered with a scavenged liquid circuit using a mechanical pump.

FIGS. 4 and 4*a* shows the basic eductor concept wherein the scavenged liquid within circuit means 29 and 31 is recycled back into the liquid injection pipe means 28 through an eductor means 31. The eductor system makes use of liquid rejected from a liquid-injected compressor discharge to siphon scavenged fluid back into the compressor thereby avoiding a separate pump.

In the basic eductor system shown in FIGS. 4 and 4*a* high pressure liquid in pipe means 25 separated from the compressor discharge system is supplied to the nozzle of an eductor 31. The jet of high velocity liquid downstream of the nozzle mixes with liquid scavenged in pipe means 29 from the compressor. The mixed stream is diffused and pressurized and passed through a heat exchanger 26 before being injected, 28, into the compressor.

The system shown in FIGS. 4 and 4*a* is best suited to a system where the scavenged liquid stream has a low flow rate relative to the rejected liquid stream. FIG. 4 and 4*a* show a system where the separator circuit means includes a heat exchanger 26 and the scavenged liquid circuit is introduced therebefore.

Higher ratios of scavenged liquid to rejected liquid steams may be accommodated a by system shown in FIGS. 5 or 6 because major the limitation to the flow ratio is the pressure drop between the eductor and the compressor. FIGS. 5 and 6 show a system where the separator circuit means includes a heat exchanger 26 and the scavenged liquid circuit is introduced thereafter. Precooling of incoming gas or vapor may be achieved by adding, a sub-system generally shown at 32 comprising, a low pressure pump, liquid reservoir and heat exchanger to the system.

ADVANTAGES AND NEW FEATURES

The scavenged liquid circuits in general have many advantages as was mentioned above. The general concept includes either a pump or an eductor means.

The compressor-scavenging eductor system has the following particular advantages. Firstly, reinjection of scavenged liquid is achieved without a power consuming pump. The driving liquid is reinjected into the compressor, first as in the conventional system, and simultaneously pumps scavenged liquid back into the system with a non-moving part eductor.

Secondly, the flows of injected, rejected and scavenged liquid all vary by the same function of discharge and suction pressures. Therefore, the system is self-regulating over a wide range of compressor operating conditions.

Lastly, the system automatically compensates for wear of compressor rotors and subsequent increased internal leakage. The amount of liquid rejected from the compressor will stay the same regardless of the condition of the compressor. The increased leakage in the compressor will be compensated for by an equal increase in injection liquid.

It will be understood that variations and modifications may be effected without department from the spirit and scope of the novel concept of this invention.

What is claimed is:

1. A positive displacement device of the liquid-injected type for varying the pressure of a gas comprising:

a pressure vessel inlet means for providing low pressure gas to the device;

a gas discharge means for allowing the discharge of the high pressure gas from the device;

a liquid injection means for cycling liquid into the device for providing sealing, cooling and lubricating;

a separator means for separating any liquid from the compressed gas exiting through the gas discharge means;

a scavenging circuit means for collecting cycled injected liquid and recycling said liquid back into the liquid injection means in a controlled manner.

2. A device according to claim 1, wherein said scavenged liquid circuit means is recycled back into the liquid injection means through a pump means.

3. A device according to claim 2, wherein said separator circuit means further comprises a throttling valve means and heat exchanger means and said scavenged liquid circuit means is introduced into said separator circuit means therebetween said throttling valve means and said heat exchanger means.

4. A device according to claim 1, wherein said scavenged liquid circuit means is recycled back into the liquid injection means through an eductor means.

5. A device according to claim 4, wherein said separator circuit means further comprises a heat exchanger means and said scavenged liquid circuit means is introduced therebefore.

6. A device according to claim 4, wherein said separator circuit means further comprises a heat exchanger means and said scavenged liquid circuit means is introduced thereafter.

7. A device according to claim 6, wherein said scavenged liquid circuit means further comprises a heat exchanger means.

8. A device according to claim 7, wherein said scavenged liquid circuit means heat exchanger means further comprises a liquid reservoir and pump means.

9. A positive displacement's, of the liquid injected type, method for varying the pressure of a gas comprising the steps of:

(a) providing a pressure vessel inlet means for providing low pressure gas to the device;
(b) allowing the discharge of high pressure gas from the device;
(c) cycling liquid into the device for sealing, cooling and lubricating;
(d) separating any liquid from the discharge of high pressure gas;
(e) collecting cycled liquid; and
(f) recycling said collected cycled liquid into the device for sealing, cooling and lubricating in a controlled manner.

10. The method according to claim 9 wherein said step of recycling is carried out by a pump means.

11. The method according to claim 9 wherein said step of recycling is carried out by an eductor means.

12. A positive displacement type device for varying the pressure of a gas comprising:

a support structure;
a mainrotor having a rotational axis, a journaling means and a toroidal surface provided with a plurality of projecting threads having crests;
a casing means, attached to said support structure, having a plurality of journaling means, a gas discharge means and a liquid injection means and having symmetry of revolution with respect to said mainrotor rotational axis;
at least one gaterotor having a rotational axis and a journaling means,
a pressure vessel, having a gas inlet means for inletting to the compressor, attached to said support structure and encasing said mainrotor, gaterotor and casing means;
wherein said mainrotor projecting thread crests are adapted to operatively cooperate with said casing and mesh with the teeth of said at least one gaterotor thereby varying the pressure of the inlet gas with respect to the pressure of the discharge gas whereby said casing means journaling means is operatively connected to said mainrotor and gaterotor journaling means wherethrough said gas discharge means which is operatively connected to said liquid injection means through a separator circuit mans, serves to seal and lubricate the cooperating rotors, characterized in that;
liquid injected through the liquid injection means is collected in the pressure vessel and recycled through a scavenged liquid circuit means, back into the injection means.

13. A device according to claim 1, wherein said scavenged liquid circuit means is recycled back into the liquid injection means through a pump means.

14. A device according to claim 13, wherein said separator circuit means further comprises a throttling valve means and heat exchanger means and said scavenged liquid circuit means is introduced into said separator circuit means therebetween said throttling valve means and said heat exchanger means.

15. A device according to claim 12, wherein said scavenged liquid circuit means is recycled back into the liquid injection means through an eductor means.

16. A device according to claim 15, wherein said separator circuit means further comprises a heat exchanger means and said scavenged liquid circuit means is introduced therebefore.

17. A device according to claim 15, wherein said separator circuit means further comprises a heat exchanger means and said scavenged liquid circuit means is introduced thereafter.

18. A device according to claim 17, wherein said scavenged liquid circuit means further comprises a heat exchanger means.

19. A device according to claim 18, wherein said scavenged liquid circuit means heat exchanger means further comprises a liquid reservoir and pump means.

20. A positive displacement type device for varying the pressure of a gas comprising:

a support structure;
a mainrotor having a rotational axis, an integral shaft for rotational support and a toroidal surface provided with a plurality of projecting threads having crests;
at least one gaterotor having a rotational axis and a means for rotational support,
a casing means, encasing said mainrotor in such a manner as to be substantially symmetrical with respect to said mainrotor rotational axis, attached to said support structure, having a plurality of means for rotationally supporting said mainrotor and gaterotor, a gas discharge means and a liquid injection means,
a pressure vessel, having a gas inlet means for inletting to the compressor, attached to said support structure and encasing said mainrotor, gaterotor and casing means
wherein said mainrotor projecting thread crests are adapted to operatively cooperate with said casing and mesh with the teeth of said at least one gaterotor thereby varying the pressure of the inlet gas with respect to the pressure of the discharge gas whereby said casing means for rotationally supporting said mainrotor and gaterotor is operatively connected to said mainrotor integral shaft and said gaterotor means for rotational support wherethrough said gas discharge means is operatively connected to said liquid injection means through a separator circuit means, serves to seal and lubricate the cooperating rotors, characterized in that;
liquid injected through the liquid injection means is collected in the pressure vessel and recycled, through a scavenged liquid circuit means, back into the liquid injection means.

21. A device according to claim 20, wherein said scavenged liquid circuit means is recycled back into the liquid injection means through a pump means.

22. A device according to claim 21, wherein said separator circuit means further comprises a throttling valve means and heat exchanger means and said scavenged liquid circuit means is introduced into said separator circuit means therebetween said throttling valve means and said heat exchanger means.

23. A device according to claim 20, wherein said scavenged liquid circuit means is recycled back into the liquid injection means through an eductor means.

24. A device according to claim 23, wherein said separator circuit means further comprises a heat exchanger means and said scavenged liquid circuit means is introduced therebefore.

25. A device according to claim 23, wherein said separator circuit means further comprises a heat exchanger means and said scavenged liquid circuit means is introduced thereafter.

26. A device according to claim 25, wherein said scavenged liquid circuit means further comprises a heat exchanger means.

27. A device according to claim 26, wherein said scavenged liquid circuit means heat exchanger means further comprises a liquid reservoir and pump means.

* * * * *